US006960969B2

(12) United States Patent
Brevart et al.

(10) Patent No.: US 6,960,969 B2
(45) Date of Patent: Nov. 1, 2005

(54) RESONANT CAVITY DEVICE CONVERTING TRANSVERSE DIMENSIONAL VARIATIONS INDUCED BY TEMPERATURE VARIATIONS INTO LONGITUDINAL DIMENSIONAL VARIATIONS

(75) Inventors: Bertrand Brevart, Toulouse (FR); Frédéric Rouchaud, Toulouse (FR); Michel Blanquet, Fonsorbes (FR); Damien Pacaud, Rue de la Fontaine (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/810,807

(22) Filed: Mar. 29, 2004

(65) Prior Publication Data

US 2004/0212463 A1 Oct. 28, 2004

(30) Foreign Application Priority Data

Apr. 25, 2003 (FR) ..... 03 05096

(51) Int. Cl.[7] ..... H01P 1/30; H01P 7/06
(52) U.S. Cl. ..... 333/229; 333/234
(58) Field of Search ..... 333/229, 230, 333/234

(56) References Cited

U.S. PATENT DOCUMENTS 4,488,132 A 12/1984 Naraine et al.
5,905,419 A 5/1999 Lukkarila
5,977,849 A 11/1999 Jordan et al.
6,529,104 B1 * 3/2003 Small et al. ..... 333/208

FOREIGN PATENT DOCUMENTS

DE 41 13 302 A1 10/1992
EP 0 939 450 A1 9/1999

* cited by examiner

*Primary Examiner*—Seungsook Ham
(74) *Attorney, Agent, or Firm*—Sughrue Mion, PLLC

(57) ABSTRACT

A resonant cavity device comprises a waveguide body having a lateral wall extending in a longitudinal direction, having a first coefficient of thermal expansion, and delimiting a resonant cavity in conjunction with opposite first and second end walls. The first end wall has a second coefficient of thermal expansion lower than the first coefficient and has an internal face fastened to a first assembly comprising at least one main plate having a third coefficient of thermal expansion lower than the first coefficient and dimensions in a plane perpendicular to the longitudinal direction less than but substantially equal to those of the cavity. An intermediate member has a fourth coefficient of thermal expansion lower than the third coefficient and an end portion fixed to the main plate which, in the event of a temperature variation, converts a dimensional variation in a direction perpendicular to the longitudinal direction into a dimensional variation in the longitudinal direction inducing longitudinal translation of the main plate inside the cavity.

16 Claims, 2 Drawing Sheets

RESONANT CAVITY DEVICE CONVERTING TRANSVERSE DIMENSIONAL VARIATIONS INDUCED BY TEMPERATURE VARIATIONS INTO LONGITUDINAL DIMENSIONAL VARIATIONS

CROSS-REFERENCE TO RELATED APPLICATIONS

This application is based on French Patent Application No. 03 05 096 filed Apr. 25, 2003, the disclosure of which is hereby incorporated by reference thereto in its entirety, and the priority of which is hereby claimed under 35 U.S.C. § 119.

BACKGROUND OF THE INVENTION

1. Field of the Invention

The field of the invention is that of resonant cavity devices.

2. Description of the Prior Art

Some resonant cavity devices comprise a waveguide body having a lateral wall extending in a longitudinal direction and delimiting at least one resonant cavity with two opposite end walls.

To limit the weight of such devices in onboard applications, especially in aeronautics, it is particularly advantageous to fabricate them from aluminum.

The person skilled in the art knows that if such devices are coupled to equipment such as multiplexers, for example output multiplexers (Omux), they are subjected to frequent temperature variations, especially if the power of the signals that they receive increases strongly. However, this also occurs in so-called "outband" operation, i.e. if the received signals have a frequency slightly outside the band of frequencies in which they are intended to function. Consequently, if the resonant cavity is delimited by aluminum walls (with a high coefficient of thermal expansion), in the presence of temperature variations it is subject to dimensional variations that induce a frequency offset of its band of frequencies.

Various solutions to this problem have been proposed.

A first solution consists in using an aluminum device and interrupting its operation if its temperature exceeds a set threshold. This avoids having to uprate the multiplexer to tolerate outband operation. However, it necessitates coupling the resonant cavity device to a thermal control device.

A second solution also consists in using an aluminum device and equipping it with a heat evacuation device, for example braids. However, this solution proves to be unsuitable if the resonant cavity device must simultaneously withstand high power levels and high interface temperatures. Furthermore, this solution leads to a weight penalty.

A third solution consists in using a device whose walls are made from a material having a very low coefficient of thermal expansion over a wide range of temperatures, for example the nickel-steel alloy known as Invar®. However, although these materials have a beneficial coefficient of thermal expansion, they do not generally offer light weight and/or low cost and/or good thermal conductivity. Moreover, resonant cavity devices made entirely of Invar® have already reached their limits in terms of power and interface temperature (because the coefficient of thermal expansion (CTE) of Invar® is not zero).

A fourth solution consists in using an aluminum device and adapting at least one of its end walls, for example as in devices described in the documents U.S. Pat. No. 6,002,310 and EP 1187247. To be more precise, the device described in the document U.S. Pat. No. 6,002,310 comprises an end wall equipped with an Invar® first wall, the central portion of which has been made thinner, and a protuberant aluminum second wall fastened to the thick peripheral edge of the first end wall. If the temperature varies, the central portion of the protuberant second wall expands, which makes it more protuberant, and constrains the Invar® first wall to flex, thereby amplifying the protuberance phenomenon. The device described in the document EP 1187247 constitutes a substantially equivalent solution. The correction of dimensional variations in the devices described in the above two documents is of limited extent, which limits the power and the interface temperature of the Omux to which they are coupled.

Thus none of the prior art devices is entirely satisfactory.

Thus an object of the invention is to improve on this situation.

SUMMARY OF THE INVENTION

To this end the invention proposes a resonant cavity device comprising a waveguide body having a lateral wall extending in a longitudinal direction, having a first coefficient of thermal expansion, and delimiting a resonant cavity in conjunction with opposite first and second end walls, wherein the first end wall has a second coefficient of thermal expansion lower than the first coefficient and has an internal face fastened to a first assembly comprising at least one main plate having a third coefficient of thermal expansion lower than the first coefficient and dimensions in a plane perpendicular to the longitudinal direction less than but substantially equal to those of the cavity, and an intermediate member having a fourth coefficient of thermal expansion lower than the third coefficient and having an end portion fixed to the main plate and adapted, in the event of a temperature variation, to convert a dimensional variation in a direction perpendicular to the longitudinal direction into a dimensional variation in the longitudinal direction inducing longitudinal translation of the main plate inside the cavity.

By operating in a way similar to a piston, the intermediate member causes the displacement of the main plate to which it is fastened, thereby compensating the dimensional variations of the resonant cavity.

A first embodiment of the device further comprises at least one assembly also comprising a main plate fastened to an intermediate member and to said intermediate member of said first assembly. In other words, a plurality of assemblies may be installed in series if the device is liable to experience high dimensional variations.

In a second embodiment of the device the first assembly comprises at least two intermediate members that are substantially identical and fastened together, the intermediate member farthest from said first end wall being fastened by its end portion to said main plate. This also compensates large dimensional variations.

Moreover, the first assembly may be fastened to the first end wall by its intermediate member. However, an intermediate plate can equally be provided, inserted between the first assembly, to which it is fastened, and the first end wall, to which it is also fastened. In this case, the intermediate plate has the third coefficient of thermal expansion and dimensions in the transverse plane less than but substantially equal to those of the cavity. The intermediate plate can itself be fastened to the first end wall by a calibration plate preferably having the first coefficient of thermal expansion and dimensions in the transverse plane less than but substantially equal to those of the cavity. This has the advantage of controlling the center frequency of the frequency band of the resonant cavity.

Furthermore, the lateral wall may be fastened to the first or second end wall by at least one shim of selected thickness.

Each intermediate member preferably has a central portion extended by first and second peripheral edges inclined at selected angles on either side of a transverse plane containing the central portion, defining a V-shaped peripheral groove, for example. Each peripheral edge can then have an end portion fastened to the main plate, the intermediate plate or the first end wall, which it faces. Moreover, each main plate and/or each intermediate plate and/or the first end wall may include a longitudinal peripheral abutment against which the end portion of the peripheral edge to which it is fastened bears.

The lateral wall and/or the second end wall and/or each intermediate member and/or each calibration plate is preferably made of aluminum. Likewise, the intermediate plates and/or the first end wall and/or each shim and/or each main plate may be made from an alloy of nickel and steel such as Invar®.

Other features and advantages of the invention will become apparent on reading the following detailed description and examining the appended drawing.

DETAILED DESCRIPTION OF THE PREFERRED EMBODIMENTS

The appended drawings may not only constitute part of the description of the invention but also contribute to the definition of the invention, if necessary.

An object of the invention is to compensate dimensional variations induced in a resonant cavity device by temperature variations.

In the description that follows, the resonant cavity device equips an output multiplexer (Omux) and is intended to filter microwave signals. For example, the device applies filtering over a frequency band of 54 MHz. Moreover, in the description that follows the resonant cavity is tubular (i.e. in the shape of a circular cylinder). However, the invention is not limited to this type of cavity alone. It relates equally to resonant cavities having a rectangular or elliptical cross section. Furthermore, in the description that follows, items that carry the same reference symbols have substantially identical functions.

Figure 1:
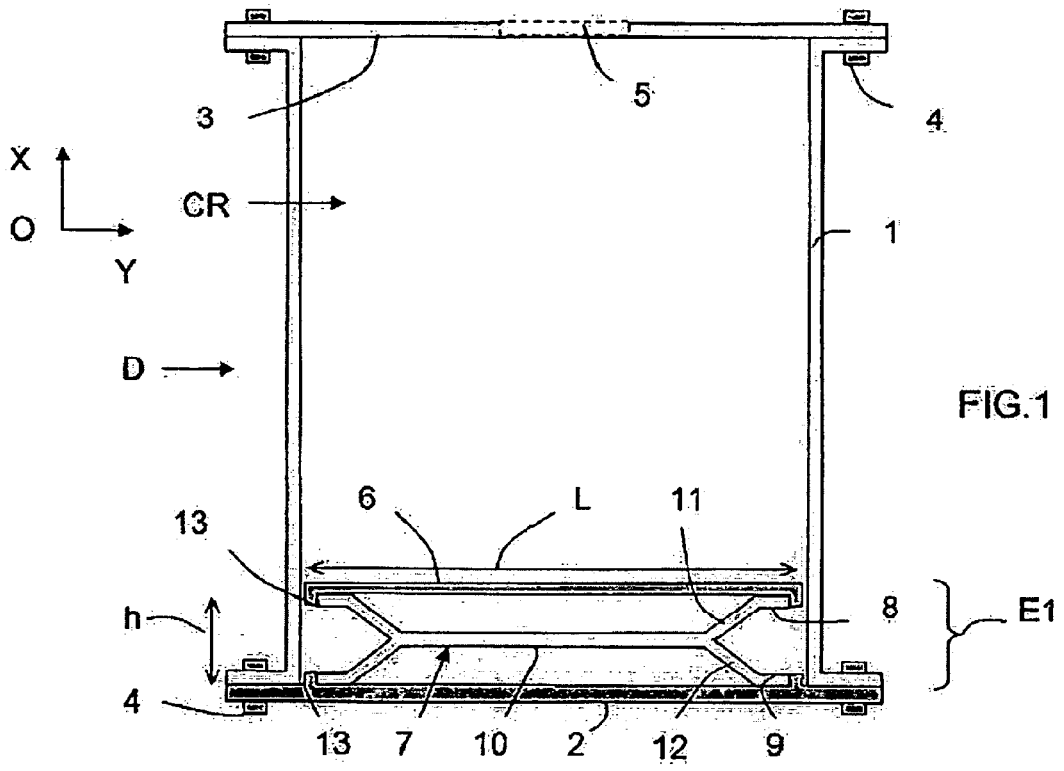
FIG. 1 is a diagrammatic longitudinal section of a first embodiment of a resonant cavity device of the invention.

A first embodiment of a resonant cavity device of the invention is described first with reference to FIG. 1.

The resonant cavity device D comprises a waveguide body having a lateral wall 1 that extends in a longitudinal direction OX and defines a resonant cavity CR in conjunction with opposite first and second walls 2 and 3 substantially contained in transverse planes (i.e. planes perpendicular to the direction OX and parallel to the direction OY).

The resonant cavity CR being of circular cylindrical shape in this example, the lateral wall 1 therefore defines a circular cylinder and the first and second end walls 2 are discs.

The lateral wall 1 has a first coefficient of thermal expansion CTE1. It is made of aluminum, for example. The first end wall 2 has a second coefficient of thermal expansion CTE2 lower than the first coefficient CTE1, and preferably close to zero. It is made of Invar® (nickel-steel alloy), for example. Finally, the second end wall 3 has the first coefficient of thermal expansion CTE1. It is made of aluminum, for example.

The lateral wall 1 has at each of its two opposite ends a transverse rim for fastening it to the first and second end walls 2 and 3, for example by means of a nut and bolt 4.

In this example, the second end wall 3 includes an opening 5 for introducing and extracting microwave signals to be filtered. Of course, access to the resonant cavity CR could be provided on the lateral wall 1.

The device D according to the invention further comprises at least one first assembly E1 comprising a transverse main plate 6 having a third coefficient of thermal expansion CTE3 lower than the first coefficient CTE1 and dimensions in the transverse plane less than but substantially equal to those of the resonant cavity CR and an intermediate member 7 having a fourth coefficient of thermal expansion CTE4 higher than the third coefficient CTE3 and having a first end portion 8 fixed to the main plate 6 and a second end portion 9 fixed to an internal face of the first end wall 2 (facing toward the interior of the cavity CR).

The resonant cavity CR being of circular cylindrical shape in this example, the main plate 6 is a disc of diameter L.

The first coefficient of thermal expansion CTE1 and the fourth coefficient of thermal expansion CTE4 are preferably the same. For example, the intermediate member 7 is made of aluminum. Likewise, the second coefficient of thermal expansion CTE2 and the third coefficient of thermal expansion CTE3 are preferably the same. For example, the main plate 6 is made of Invar®.

The intermediate member 7 has a longitudinal dimension h and is specifically adapted to convert its dimensional variations ΔL (expansion) in the transverse plane, induced by a temperature variation, into a dimensional variation Δh in the longitudinal direction OX.

Because the intermediate member 7 is fastened to the main plate 6, the dimensional variation Δh in the longitudinal direction OX causes longitudinal translation of the main plate 6 inside the resonant cavity CR. In other words, the greater these dimensional variations ΔL of the intermediate member 7, the greater its dimensional variation Δh and thus the greater the amplitude of longitudinal translation of the main plate 6. This therefore controls dimensional variations of the resonant cavity CR, so that its central operating frequency remains substantially constant over a selected range of temperature.

A coefficient of thermal expansion equivalent $CTE_{eq}$ for the assembly E1 can be approximately defined by the following equation:

$$CTE_{eq}=CTE4+(L/H)*CTE4$$

This equation shows that compensation improves as the ratio L/h increases.

In the example depicted in FIG. 1, the intermediate member 7 has a central portion 10 extended by first and second peripheral edges 11 and 12, which are circular in this example, inclined at selected angles on either side of a transverse plane containing the central portion 10, thus defining a peripheral groove.

The angles are preferably the same. They are selected as a function of the amplitude of the translation required. For example, each angle is a few tens of degrees, typically from 20° to 45°.

The peripheral groove has a V-shaped section, for example. However, it can equally well be in the shape of a crescent moon, an open "U", or the like.

The peripheral edges 11 and 12 are each terminated by one of the transverse end portions 8, 9 respectively fastened to the main plate 6 and to the first end wall 2.

Moreover, in order to constrain the intermediate member 7 to convert its dimensional variations ΔL into dimensional variations Δh, the main plate 6 and the first end wall 2 preferably each comprise a circular longitudinal peripheral abutment 13 against which bears the end portion 8 or 9 of the peripheral rim 11 or 12 to which it is fastened.

Figure 2:
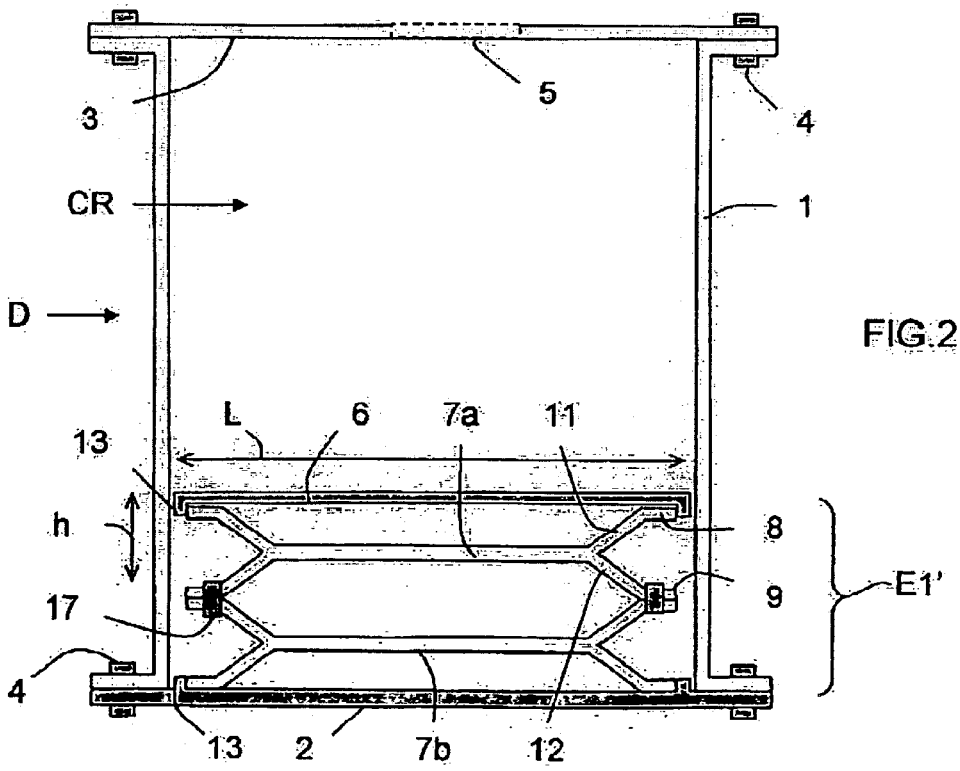
FIG. 2 is a diagrammatic longitudinal section of a second embodiment of a resonant cavity device of the invention.

A second embodiment of a resonant cavity device of the invention is described next with reference to FIG. 2.

This embodiment is a variant of the first embodiment described with reference to FIG. 1, in which the first assembly E1' comprises two intermediate members 7*a* and 7*b* rather than only one.

To be more precise, in this embodiment, a first intermediate member 7*a* is fastened by its peripheral rim 11 to the main plate 6 and by its peripheral rim 12 to the peripheral rim 11 of a second intermediate member 7*b* whose other peripheral rim 12 is fastened to the internal face of the first end wall 2. The peripheral rims 12 and 11, respectively the intermediate members 7*a* and 7*b*, are preferably fastened by an exterior ring 17 which has the third coefficient of thermal expansion. The ring 17 is made of Invar®, for example.

The intermediate members 7 disposed in series in this way are preferably substantially identical. This is not obligatory, however.

This embodiment compensates strong dimensional variations. The number of intermediate members 7 constituting the first assembly E1' can be other than two, of course.

Figure 3:
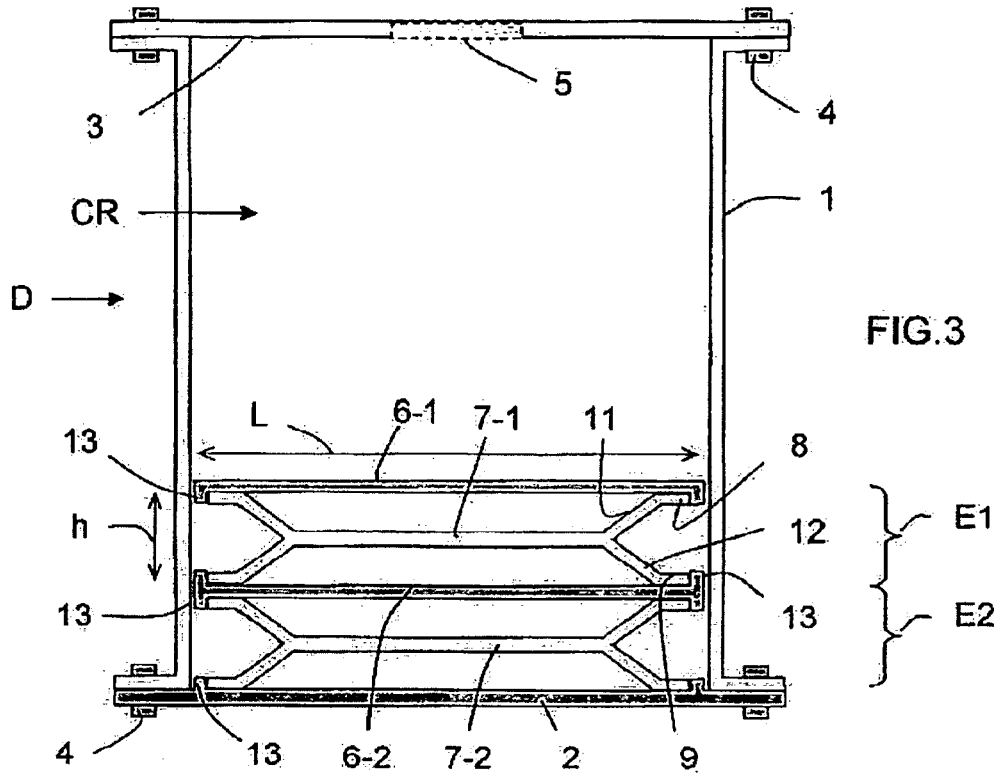
FIG. 3 is a diagrammatic longitudinal section of a third embodiment of a resonant cavity device of the invention.

A third embodiment of a resonant cavity device of the invention is described next with reference to FIG. 3.

This embodiment comprises a first assembly E1 substantially identical to that described previously with reference to FIG. 1 fastened to a second assembly E2 also comprising a main plate 6-2 fastened to an intermediate member 7-2.

To be more precise, in this embodiment, the peripheral rim 12 of the intermediate member 7-1 of the first assembly E1 is fastened to an internal face of the main plate 6-2 of the second assembly E2 and the peripheral rim 12 of the intermediate member 7-2 of the second assembly E2 is fastened to the internal face of the first end wall 2.

As shown here, the main plate 6-2 preferably also has on its internal face a second circular longitudinal peripheral abutment 13 against which bears the end portion 9 of the peripheral rim 12 of the intermediate member 7-1.

Apart from the second abutment 13, the assemblies E1 and E2 disposed in series in this way are preferably substantially identical. This is not obligatory, however.

This embodiment also compensates large dimensional variations. The number of assemblies disposed in series can be other than two, of course.

Figure 4:
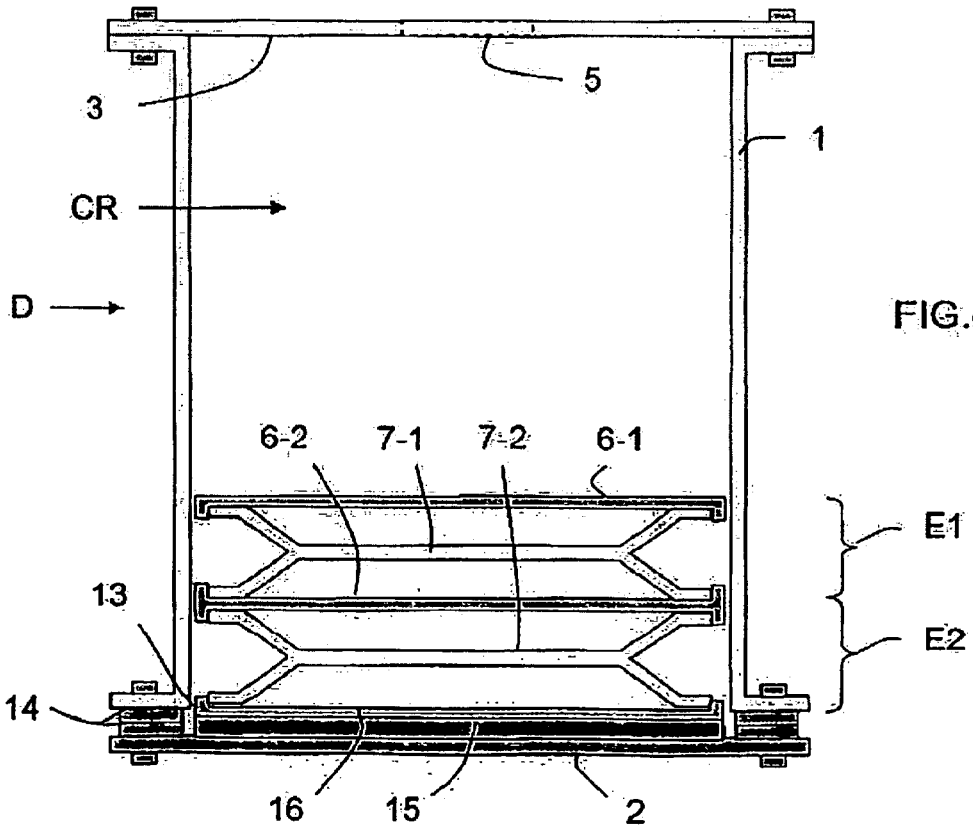
FIG. 4 is a diagrammatic longitudinal section of a fourth embodiment of a resonant cavity device of the invention.

A fourth embodiment of a resonant cavity device of the invention is described next with reference to FIG. 4.

This embodiment is a variant of the third embodiment previously described with reference to FIG. 3, in which the longitudinal dimension of the resonant cavity CR is controlled with the aid of one or more shims 14 of selected thickness, a calibration plate 15 of selected thickness, and/or an intermediate plate 16 of selected thickness.

To be more precise, in this embodiment, one or more shims 14 are provided in the form of washers with a thickness chosen as a function of the central operating frequency of the resonant cavity, the height of the assemblies E1 and E2, and the sum of their longitudinal displacement amplitudes Δh. The washers 14 are placed between the first end wall 2 and one of the transverse rims of the lateral wall 1, for example. However, they could be placed at the other end of the resonant cavity CR, between the second end wall 3 and the other transverse rim of the lateral wall 1, or one at each end.

Each shim 14 is preferably made of a material having a very low coefficient of thermal expansion, for example Invar®.

There is further provided a calibration plate 15 fastened to the internal face of the first wall 2 and to an external face of an intermediate plate 16 whose internal face is fastened to the end portion 9 of the peripheral rim 12 of the intermediate member 7-2 of the second assembly E2.

The calibration plate 15 is preferably made of aluminum (which is a material with a high CTE).

Moreover, to constrain the intermediate member 7-2 to convert its transverse dimension of variation ΔL into a sufficient longitudinal dimension of variation Δh, the intermediate plate 16 is preferably substantially identical to a main plate 6, in terms of its dimensions, its longitudinal peripheral abutment 13, and the material from which it is made.

The foregoing description refers to a device D equipped with a single resonant cavity CR. However, coupling two devices D disposed longitudinally in a head-to-tail arrangement to constitute a single device with two resonant cavities may be envisaged. In this case, the two resonant cavities communicate via the appropriate opening 5 and at least one other opening is provided on the lateral wall 1 for signals to enter and leave said resonant cavities.

The invention is not limited to the resonant cavity device embodiments described above by way of example only, and encompasses any variation that the person skilled in the art might envisage falling within the scope of the following claims.

There is claimed:

1. A resonant cavity device comprising a waveguide body having a lateral wall extending in a longitudinal direction, having a first coefficient of thermal expansion, and delimiting a resonant cavity in conjunction with opposite first and second end walls, wherein said first end wall has a second coefficient of thermal expansion lower than said first coefficient and has an internal face fastened to a first assembly comprising at least one main plate having a third coefficient of thermal expansion lower than said first coefficient and dimensions in a plane perpendicular to said longitudinal direction less than but substantially equal to said cavity, and an intermediate member having a fourth coefficient of thermal expansion higher than said third coefficient and having an end portion fixed to said main plate and adapted, in response to a temperature variation, to convert a dimensional variation in a direction perpendicular to said longitudinal direction into a dimensional variation in said longitudinal direction inducing longitudinal translation of said main plate inside said cavity.

2. The device claimed in claim 1 further comprising a second assembly also comprising a main plate fastened to an intermediate member and to said intermediate member of said first assembly.

3. The device claimed in claim 2 wherein said second assembly is substantially identical to said first assembly.

4. The device claimed in claim 1 wherein said first assembly comprises at least two intermediate members that are substantially identical and fastened together, the intermediate member farthest from said first end wall being fastened by its end portion to said main plate.

5. The device claimed in claim 4 wherein said intermediate members are fastened together in pairs by an exterior ring having said third coefficient of thermal expansion.

6. The device claimed in claim 1 wherein said first assembly is fastened to said first end wall by its intermediate member.

7. The device claimed in claim 1 further comprising an intermediate plate having said third coefficient of thermal expansion, having dimensions in a plane perpendicular to said longitudinal direction less than but substantially equal to said resonant cavity, and disposed between said first assembly, to which it is fastened, and said first end wall, to which it is also fastened.

8. The device claimed in claim 7 wherein said intermediate plate is fastened to said first end wall by a calibration plate having said fourth coefficient of thermal expansion and dimensions in a plane perpendicular to said longitudinal direction less than but substantially equal to said resonant cavity and said lateral wall is fastened to said first end wall or said second end wall by at least one shim of selected thickness.

9. The device claimed in claim 1 wherein said intermediate member has a central portion extended by first and second peripheral rims inclined at selected angles on either side of a plane containing said central portion, thereby defining a peripheral groove.

10. The device claimed in claim 9 wherein said peripheral groove has a substantially V-shaped cross section.

11. The device claimed in claim 9 wherein each peripheral rim has an end portion fastened to said main plate, said first end wall, or to an intermediate plate displaced between said first assembly and said first end wall.

12. The device claimed in claim 11 wherein each main plate and/or each intermediate plate and/or said first end wall comprises at least one longitudinal peripheral abutment on which bears said end portion of said peripheral rim to which it is fastened.

13. The device claimed in claim 1 wherein said first and fourth coefficients of thermal expansion are equal.

14. The device claimed in claim 1 wherein said second and third coefficients of thermal expansion are equal.

15. The device claimed in claim 8 wherein said lateral wall and/or said second end wall and/or each intermediate member and/or each calibration plate is made of aluminum.

16. The device claimed in claim 8 wherein said intermediate plate and/or said first end wall and/or each shim and/or each main plate is made from an alloy of nickel and steel.

* * * * *